US005184933A

United States Patent [19]

Pei-qian et al.

[11] Patent Number: 5,184,933

[45] Date of Patent: Feb. 9, 1993

[54] MINI-SIZE UNIVERSAL HYDRAULIC EXCAVATOR

[75] Inventors: Zhong Pei-qian, Tianjin; Zheng Wen-kang; Xu Xi-tian, both of Yulin; Liang Jian-he, Nanning; Zhou Dong-shen, Yulin; Yang Jun-zhi, Lanzhou, all of China

[73] Assignee: Yulin Diesel Engine General Works, Yulin, China

[21] Appl. No.: 661,985

[22] Filed: Feb. 27, 1991

[30] Foreign Application Priority Data

Apr. 4, 1990 [CN] China ..... 90204307.2

[51] Int. Cl.[5] ..... B66C 3/02

[52] U.S. Cl. ..... 414/725; 91/54; 180/53.4

[58] Field of Search ..... 414/725, 722, 687, 694, 414/695.5; 91/54; 60/329; 180/53.4; 173/27; 37/DIG. 2, DIG. 3

[56] References Cited

U.S. PATENT DOCUMENTS

| | | | |
|---|---|---|---|
| 3,174,410 | 3/1965 | Booth et al. | 60/329 X |
| 3,864,852 | 2/1975 | Lochrie | 37/141 R |
| 3,872,986 | 3/1975 | Campbell | 37/DIG. 2 |
| 4,087,010 | 5/1978 | Stormon | 37/117.5 X |
| 4,126,993 | 11/1978 | Grattapaglia et al. | 60/329 |
| 4,172,615 | 10/1979 | Hakes | 173/27 X |
| 4,728,251 | 3/1988 | Tskashima et al. | 414/695.5 X |
| 4,881,371 | 11/1989 | Haeder et al. | 180/53.4 X |
| 4,966,240 | 10/1990 | Aikawa | 414/687 X |

FOREIGN PATENT DOCUMENTS

| | | |
|---|---|---|
| WO87/04201 | 7/1987 | PCT Int'l Appl. . |
| 2168301 | 6/1986 | United Kingdom . |

*Primary Examiner*—Michael S. Huppert
*Assistant Examiner*—Donald W. Underwood
*Attorney, Agent, or Firm*—Seed & Berry

[57] ABSTRACT

A mini-size universal hydraulic excavator capable of performing independently many operating processes, such as digging, pushing, grabbing, drilling and chipping, having essentially three main sections, namely, a chassis carrying traveling device pivotally connected with an earth-moving means, a complete swivel upper carriage provided with a power generator and a driver's seat, and an excavating arm having a boom, a bucket arm, and a bucket. A hydraulic chipper can be connected to the main machine without the necessity of removal of the bucket and the earth-moving means, so that chipping and site clearing can be carried on simultaneously solely by one single machine. A backhoe bucket carrying a scraper employs a multi-bar linkage mechanism having a bucket body, a scraper, and a bucket arm so that the bucket can have sufficient bucket capacity in a relatively greater excavating revolving angle range. Specially-set accessory operating equipment oil lines are used to drive all the hydraulic operation equipments except the bucket.

2 Claims, 6 Drawing Sheets

MINI-SIZE UNIVERSAL HYDRAULIC EXCAVATOR

Figure 1:
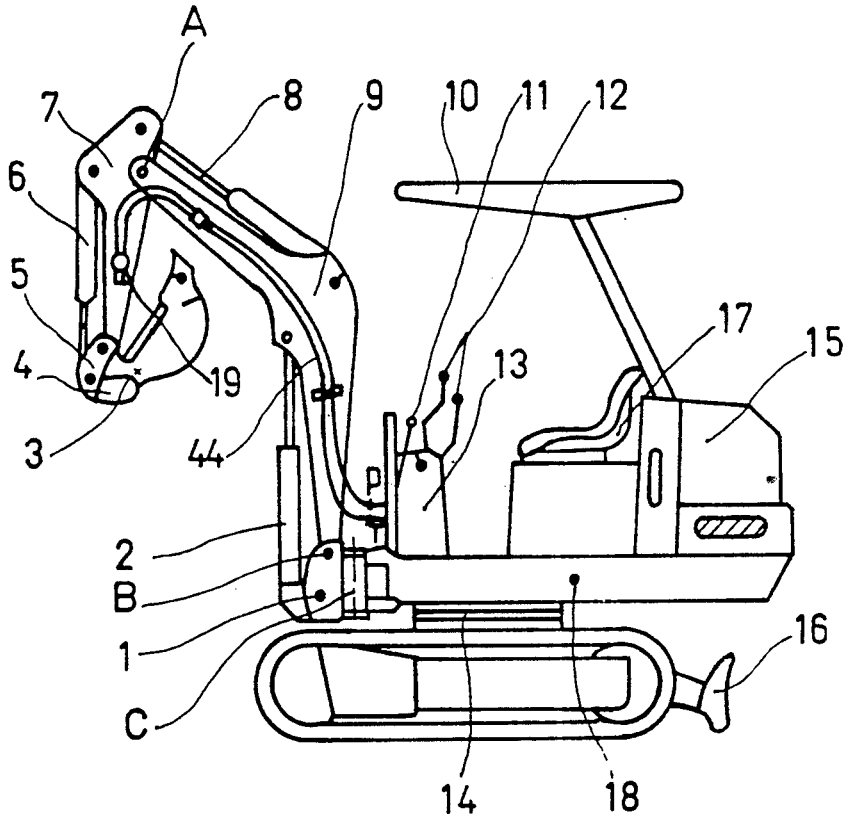

The present invention relates to an excavator, particularly to a mini-size universal hydraulic excavator suitable for narrow sites and small work load.

For some engineering projects, such as laying cables or pipelines, it is necessary first to dig a trench, then to lay the cable or pipeline therein and finally to backfill the trench; when meeting with hard objects, it is necessary to break them. In order to mechanically perform various works for these project, many kinds of machine, such as excavator, bulldozer and chipper may be required to operate in coordination. This is very uneconomical in the cases of a narrow site and/or small work load, even resulting in incapability of realization of full-mechanization of operation. Though some of the conventional excavators are provided with excavating, earth moving and chipping means, yet none of them can do the excavating and the chipping work simultaneously, and moreover, it is necessary first to remove the bucket and then to replace it with a chipper. This is very troublesome. It will be much more troublesome, if on some occasions, it is required that chipping and clearing away the chipped fragments be done simultaneously, as in that case, if only one single machine is to be employed, there bound to be frequent replacements in turn of bucket and hydraulic chipper. Besides, on some other occasions it is necessary to dig up clay which is subject to adhere to the bucket not easily to be cleared away. This is apt to reduce the effective capacity of the bucket and prolong the unloading time. To solve this problem, the conventional way is to employ a bucket carrying a scraper, as shown is FIG. 3, But as a simple device of four-bar linkage mechanism is employed, the scraper can substantially make translational movements of small range and the movement of the scraper relative to the bucket almost entirely depend on the revolving movement of the bucket. The effective revolving angle of excavation is relatively small, which lowers the adaptibility of the excavating process, and prolongs the time for adjusting the position of the excavating arm relative to the main machine during the operation process, the result still being unsatisfactory.

Consequently, the object of the present invention is to provide a multifunctional mini-size universal hydraulic excavator which can perform simultaneously such processes as chipping and digging in a narrow site and is able to conveniently and effectively cope with clay and hard objects.

The excavator proposed by the present invention includes those excavators which are equipped simultaneously with earth moving means, backhoe means and hand-held hydraulic chipper, and also those excavators, some parts of which are replaceable with grab bucket, ditch cleaning bucket, hydraulic chipper, V-type bucket and drilling tools, etc., useful for digging and cleaning ditches, crushing concrete or stones and drilling soil, etc. Said excavator is characterized in that it comprises simultaneously three operating equipments for earth moving, digging and chipping and is able to carry on digging and chipping at the same time. The scraping means it employs not only ensures a high efficiency of scraping off the earth, but chiefly makes the bucket have sufficient bucket capacity in a greater range of revolving angle for excavation to carry on the digging process as well. Besides, the specially-set oil line including the quick-change joint for the accessory operating equipments can conveniently drive any other hydraulic operating equipments.

A mini-size universal hydraulic excavator according to the present invention comprises:

a chassis assembly including traveling devices and a vehicle frame, an earth moving means pivotally connected to said chassis assembly, a complete swivel supporting means fixedly connected to the chassis assembly, an upper carriage assembly provided with main hydraulic system, supporting frame for multi-way valves, a driver's shed or cabin, a driver's seat, a power set, control mechanism and electrical system, etc. and fixedly mounted on the swivel supporting means, an excavating arm pivotally connected to the carriage assembly and including a joint holder, boom, bucket arm and driving oil cylinders, implements such as bucket, drilling tools mounted on the excavating arm, characterized in that:

it is provided further with accessory operating equipments oil lines communicating with the main hydraulic system, and a quick receptacle means communicating with the main hydraulic system or the accessory operating equipments oil lines, for connecting with the hand-held hydraulic chipper, and that the bucket is provided with a multi-bar linkage mechanism comprised of a bucket body, a scraper, a swing bar and a bucket arm etc., driven by the same oil cylinder, the bucket body and the scraper revolve in the same direction with a rule that the bucket body moves quicker while the scraper moves slower, so that the bucket may have sufficient bucket capacity in a greater revolving angle range to carry on digging.

For the excavator according to the present invention, the hand-held hydraulic chipper can be connected with the oil lines of the main machine by means of the driving oil tube and receptacle means without removal of the bucket or the earth-moving means; the connection point might be the accessory operating equipments oil line, or it might also be the pre-set receptacle of the main hydraulic system.

In the excavator according to the present invention, said receptacle means might be at least a quick-change joint and a receptacle or it might be a combination of a quick-change joint and a receptacle containing a pressure controller, a temperature controller or a warning device. Said multi-bar linkage mechanism provided on said bucket might be a five-bar or six-bar linkage mechanism including a bucket body, a scraper and a bucket arm.

Figure 2:
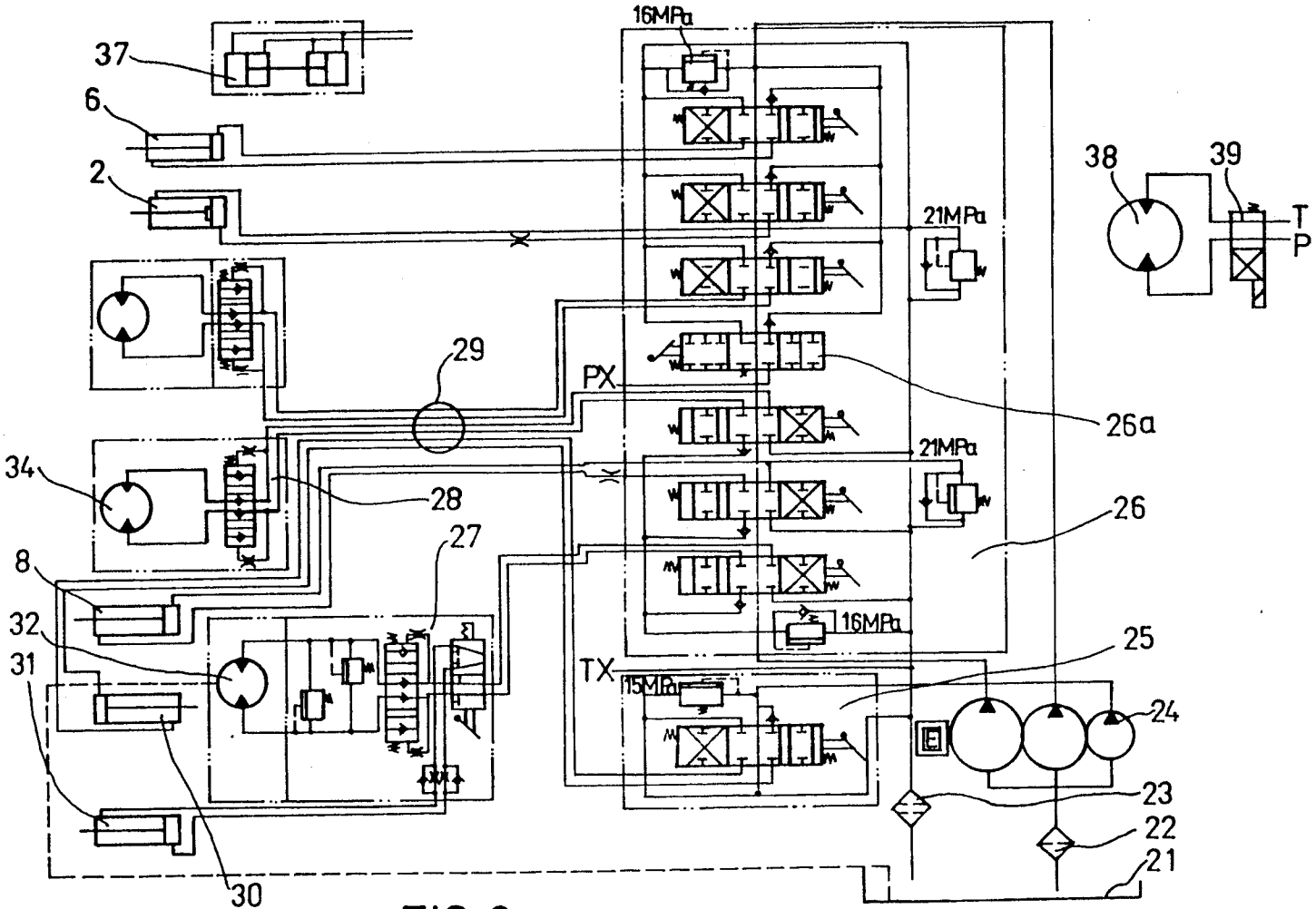
Figure 4:
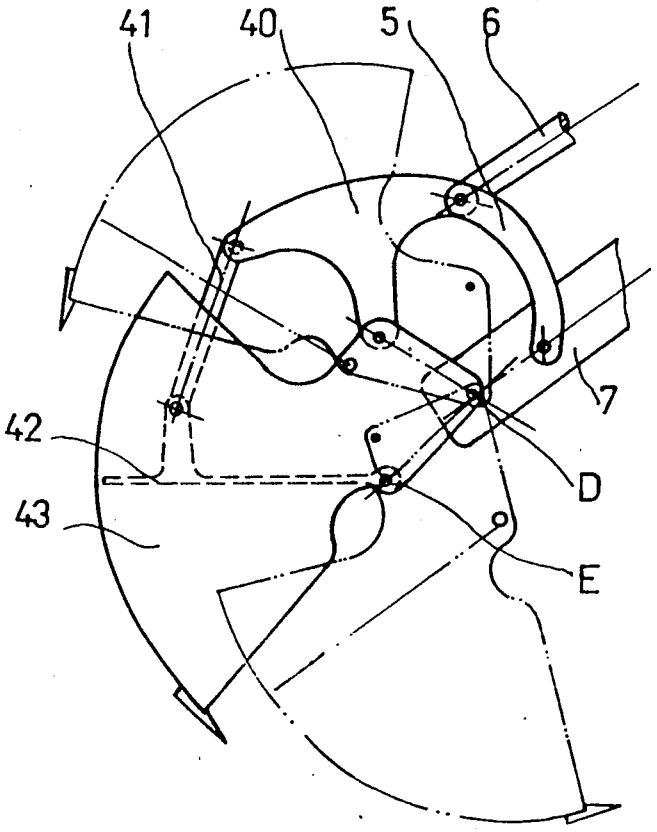
Figure 3:
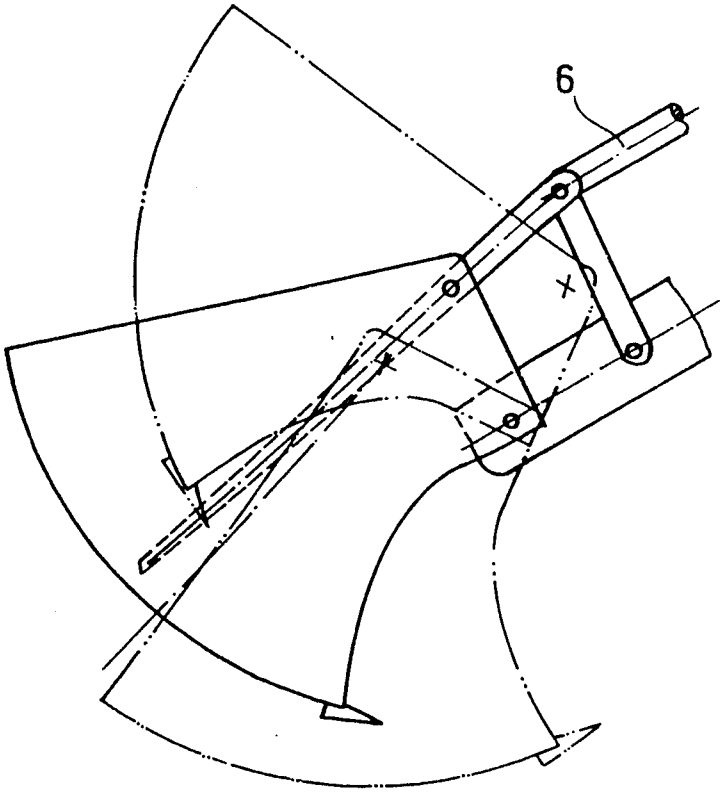
FIG. 3 (Prior Art)
Figure 5:
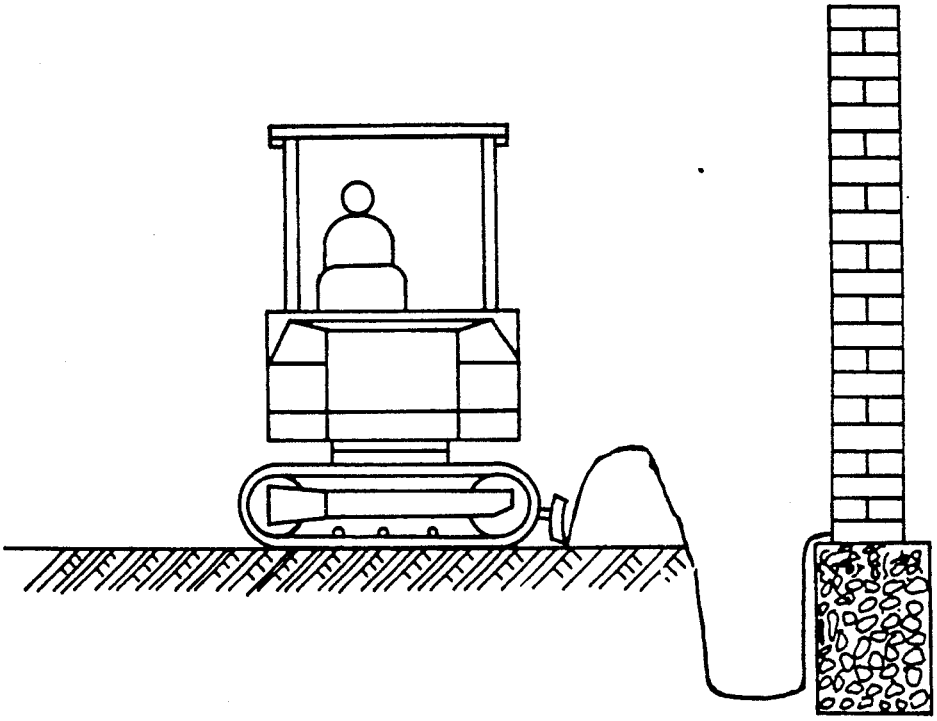
Figure 6:
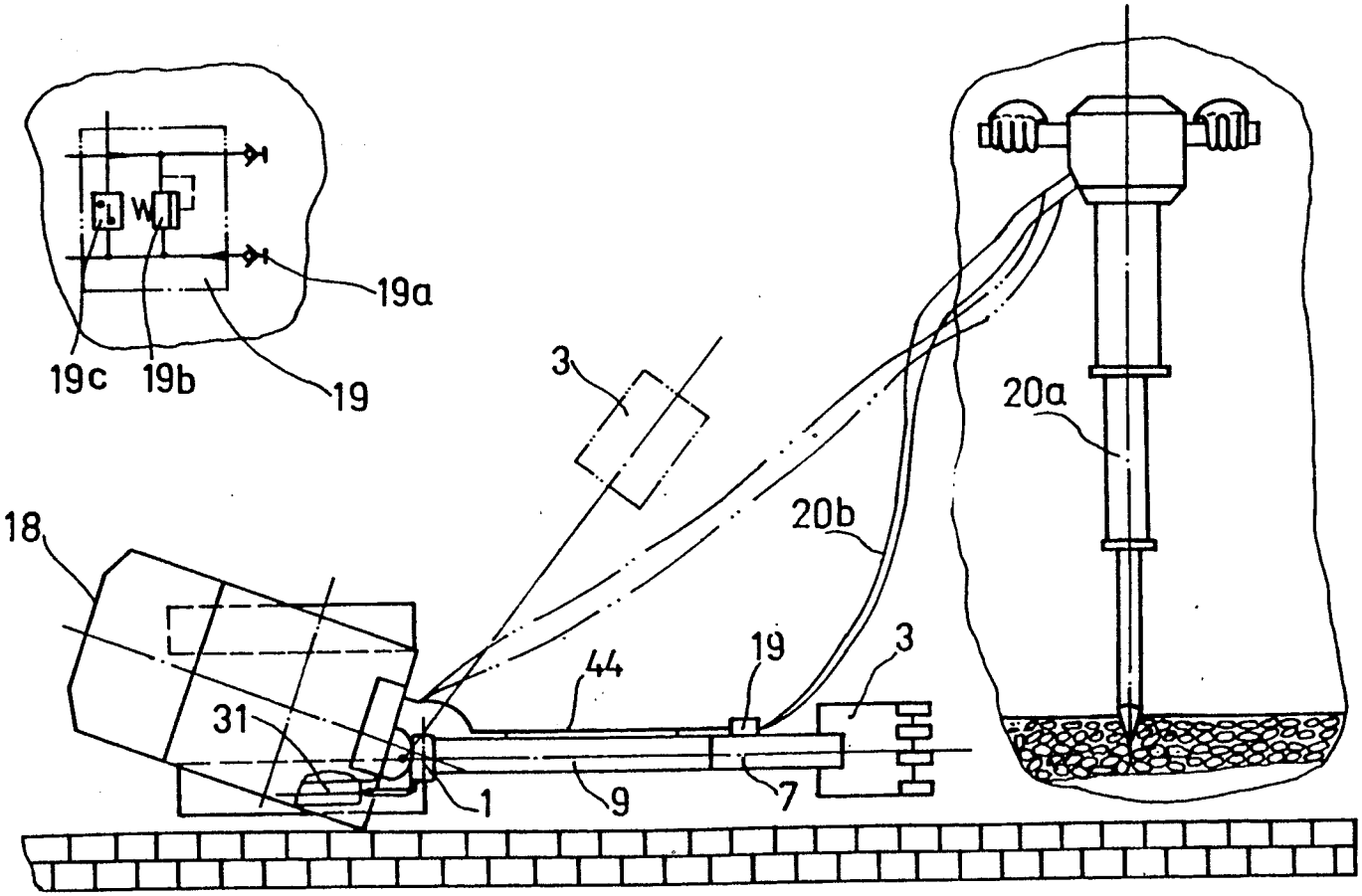
Figure 7:
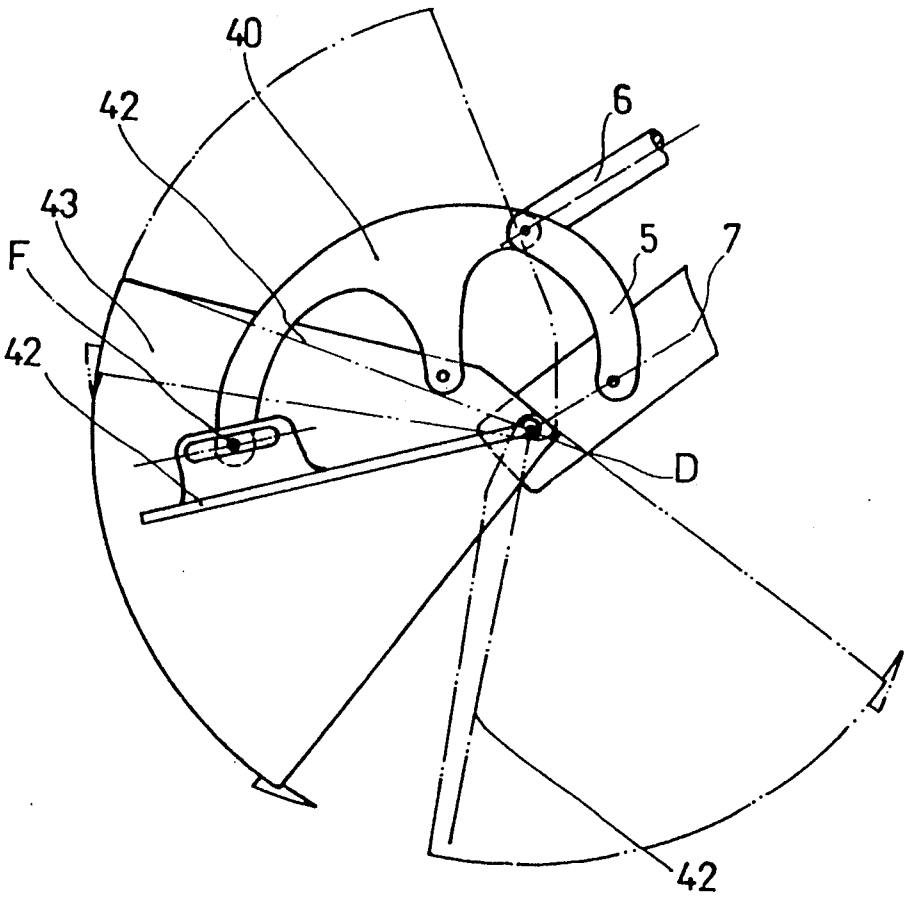

The following is a description of the preferred embodiment of the present invention with reference to the accompanying drawings, in which:

FIG. 1 is a side view of the excavator according to the present invention,

FIG. 2 is a schematic diagram of the hydraulic system of the excavator according to the present invention, FIG. 3 is a diagrammatic drawing of a conventional backhoe bucket with a scraper, FIG. 4 is a diagrammatic drawing of a backhoe bucket with a scraper according to the present invention, FIG. 5 is a diagrammatic drawing of the excavator according to the present invention operating at moving earth for backfill along a wallside, FIG. 6 is a diagrammatic drawing of the excavator according to the present invention operating at digging along a wallside and operating with a hand-held hydraulic chipper, FIG. 7 is a diagrammatic drawing of an alternative embodiment of a backhoe bucket with a scraper of the excavator according to the present invention.

As shown in FIG. 1, an excavator according to the present invention comprises a chassis assembly employing crawler traveling devices and an upper carriage assembly mounted on the chassis by means of a swivel support 14, the upper carriage assembly being swivellable completely over 360 degrees; on the upper carriage are mounted a joint holder 1, a boom 9 and a bucket arm 7, forming an excavating arm capable of making independent horizontally swing motion, the joint holder 1 being pivotally connected to the swivel carriage 18 at pivot C, the boom 9 being pivotally connected to the joint holder 1 at pivot B and the bucket arm 7 being pivotally connected to the boom 9 at pivot A. The ends of the hydraulic cylinder 8 are pivotally connected to the boom 9 and the bucket arm 7 respectively, the bucket arm 7 driven by the hydraulic cylinder 8 being made to be pivotable on the horizontal pivot axis A; the ends of the hydraulic cylinder 2 are pivotally connected to the joint holder 1 and the boom 9 respectively, the boom 9 driven by the hydraulic cylinder 2 being made to be pivotable up and down about the horizontal pivot axis B located in the joint holder 1; the ends of the hydraulic cylinder 31 (see FIG. 6) are pivotally connected to the swivel carriage 18 and the joint holder respectively, the joint holder 1 driven by the hydraulic cylinder 31 being made to cause the excavating arm to be pivotable horizontally within a small range, about the pivot axis C located at the front end of the upper carriage; a backhoe bucket 3 with a multi-bar linkage machanism is mounted on the outer end of the excavating arm to form an excavating assembly; an oil cylinder 6 is pivotally connected at one end to the bucket arm 7 and at the other end to the multi-bar linkage mechanism, the pivotal joint being not on the bucket arm 7 or the bucket 3. Driven by the oil cylinder 6, the bucket 3 is made to revolve relative to the bucket arm 7 within a plane defined by the excavating arm. In consideration of the different requirements of various working operations, the bucket 3 might be a standard backhoe bucket, or it might be replaced with a backhoe bucket carrying a scraper, a ditch cleaning bucket or a V-type bucket or it might also be replaced by means of connection means with such accessory tools as a grab bucket, a hydraulic chipper and a drill. Through operating the control elements of the hydraulic system and adjusting the excavating arm to a suitable position, it is ready to begin the excavating work. When the excavator is escavating along a wall side and is inconvenient to swivel completely to unload, the operator can conveniently carry on the excavating and unloading by means of the independent small-range swing motion of the excavating arm, as shown in FIG. 6. The main part of FIG. 6 is a top diagrammatic view of an excavator doing escavating work along a wallside, the part encircled by the wavy line being a front diagrammatic view of a hand-held hydranlic chipper in operation and a schematic functirnal view of the receptacle means.

The material dug out can be directly unloaded into vehicles for removal. If it only needs piling, levelling, backfilling or short-distance transportation, the earth-moving means of the excavator according to the present invention can be used. The earth-moving means comprises essentially an earth-moving spade 16 pivotally connected to the chassis and an earth-moving oil cylinder 30 (FIG. 2) pivotally connected at both ends to the chassis and the earth-moving spade respectively. Driven by the earth-moving oil cylinder 30, the earth-moving spade is made to be raised or lowered relative to the chassis. By operating the control unit of the hydraulic driving system to set the earth-moving spade at an appropriate position, the main machine body is moving to carry on earth moving process. When it requires to backfill a trench along a wall side, in order to reach the operating site more approachingly, the carriage 18 can be made to turn 90 (or 270 ), to carry on the earth moving process in a state perpendicular to the length of the chassis, as shown in FIG. 5.

In the operation of digging clay, a backhoe bucket carrying a scraper should be used. The backhoe device carrying a scraper according to the present invention is comprised of a multi-bar linkage mechanism not less than five-bars including the bucket itself and the scraper. It ensures not only a satisfactory efficiency of scraping off the earth, but chiefly makes the bucket have sufficient bucket capacity in a greater range of revolving angle for excavation to carry on the digging process as well. FIG. 4 shows a preferred embodiment of the backhoe bucket carrying a scraper according to the present invention. The bottom surface of the bucket is of circular arcuate shape and the back wall is a movable scraper 42. A bucket body 43, a scraper 42, a connecting rod 41, a swing bar 5, a bucket arm 7 and a connecting plate 40 altogether constitute a six-bar linkage mechanism. In reality, it can be decomposed into two four-bar linkage mechanism, in which the bucket body 43 is connected with the excavating arm by means of a pivotally connected four-bar linkage mechanism comprised of the bucket body itself together with the bucket arm 7, the swing bar 5 and the connecting plate 40; the scraper 42 with the bucket body 43, the connecting plate 40 and the connecting rod 41 also form a pivotally connected four-bar linkage mechanism. As shown in FIG. 4, the swing bar 5 is pivotally connected to the bucket arm 7 and the connecting plate 40, respectively, and the bucket body 43 is also pivotally connected to the bucket arm 7 and the connecting plate 40, respectively, forming a first pivotally connected four-bar linkage mechanism. Connecting rod 41 is pivotally connected to the connecting plate 40 and the scraper 42, respectively, and the bucket body 43 is pivotally connected to the scraper 42 and the connecting plate 40, respectively, forming a second pivotally connected four-bar linkage mechanism. The oil cylinder 6 is pivotally connected to the pivot between the swing bar 5 and the connecting plate 40. These two four-bar linkage mechanisms move in coordination under the driving action of the oil cylinder 6, that is, with the revolving of the bucket body 43 about the pivot axis D, the scraper 42 also revolves in the same direction about the pivot axis E, However, regardless of whether it revolves forward or backward, the revolving speed of the scraper 42 is a fixed amount less than the revolving speed of the bucket body 43. In other words, through the excavating process, with the forward revolvement of the bucket body 43, the scraper 42 would revolve backward relative to the bucket body 43 at a definite speed, enlarging the effective capacity of the bucket and thus achieving the goal of loading more. In the unloading process, with the backward revolvement of the bucket body 43, the scraper 42 would revolve forward relative to the bucket body 43 at a definite speed, gradually reducing the effective capacity of the bucket, thus performing the task of unloading. This makes the bucket have s sufficient bucket capacity in a greater revolving angle range to carry on digging. This enhances the adaptability of the bucket to the excavating position and reduces the operation adjusting time for the bucket so that the working efficiency is improved.

The backhoe bucket carrying a scraper can be brought about not only by means of a six-bar linkage mechanism described in the afore-mentioned embodiment, but by means of a five bar linkage mechanism as well. FIG. 7 shows another embodiment of the backhoe bucket carrying a scraper according to the present invention. The bottom surface of the bucket presents a circular arcuate shape and its backwall is a movable scraper 42. A bucket body 43, a scraper 42, a swing bar 5, a bucket arm 7 and a connecting plate 40 jointly constitute a five-bar linkage mechanism. This five-bar linkage mechanism can be decomposed into a four-bar linkage mechanism and a crank-connecting rod-slide block mechanism, in which the pivotally connected four-bar linkage mechanism comprised of the bucket body 43, the bucket arm 7, the swing bar 5 and the connecting plate 40 is connected with the excavating arm, while the scraper 42, the connecting plate 40 and the bucket body 43 form a crank-connecting rod-slide block mechanism. As shown in FIG. 7, the swing bar 5 is pivotally connected to the bucket arm 7 and the connecting plate 40, respectively, and the bucket body 43 is also pivotally connected to bucket arm 7 and the connecting plate 40, respectively, forming a pivotally connected four-bar linkage mechanism. The scraper 42 is pivotally connected to the bucket body 43, and the connecting plate 40 is slideably connected to the scraper 42 by means of a pin slide block F, forming a crank-connecting rod-slide block mechanism. It can be clearly seen from FIG. 7 that a sliding guide is provided on the scraper 42, and the pin slide block F can slide freely only in the direction along the length of the sliding guide, but not in other directions. The oil cylinder 6 is pivotally connected to the pivot between the swing bar 5 and the connecting plate 40. The five-bar linkage mechanism comprised of these two mechanisms operates coordinately under the driving action of the oil cylinder 6, that is, with the revolvement of the bucket about the pivot axis D, the scraper 42 revolves in the same direction also about the pivot axis D. The effectiveness it produced is substantially the same as what the above-mentioned six-bar linkage mechanism produces.

As mentioned above, the backhoe bucket carrying scraper of the present invention may comprise a six-bar linkage mechanism or a five-bar linkage mechanism including the bucket body 43 and the scraper 42. However, the structure of the five-bar linkage mechanism is simpler, lighter, and handier than that of the six-bar linkage mechanism. The track of movement of the slide block of the five-bar linkage mechanism can be determined according to practical requirements. It has better adaptability in its function towards the process of digging and unloading and is more convenient and more flexible in designing.

FIG. 6 shows an embodiment of the use of the hand-held chipper according to the present invention. If hard objects such as stones or concrete blocks are encountered during the excavating process, the excavating operation will be forced to stop. A hand-held hydraulic chipper can be mounted on at this time without the removal of the backhoe bucket. As shown in FIG. 6, the hand-held hydraulic chipper **20*a* can be quickly connected with the accessory operating equipments oil line 44 of the main machine by means of the quick receptacle means 19 and the driving oil tube 20*b*. The accessory operating equipments oil line 44 is fixed on the excavating arm and connected with the pre-set ports P and T (FIG. 2) of the multi-way valves of the main hydraulic system, wherein the port P is the outlet for the pressure oil, and the port T the inlet for return oil. By mainpulating the foot pedal convergent flow valve 26*a* of the hydraulic system and the hand-operated valve (not shown) of the hydraulic chipper, the pressure oil of the main machine is transmitted to the hydraulic chipper to drive it to carry on the chipping and crushing process. As the hand-held hydraulic chipper is connected to the main machine by means of the quick receptacle means and the driving oil tube, it can carry on chipping in a certain area at some distance from the main machine or spots the main machine can not reach. In order to be fit for various different hydraulic chippers, a receptacle means 19 having the functions of controlling the pressure and temperature is provided at the juncture of the chipper's driving oil tube 20*b* and the main machine's hydraulic system, so that the chipper and the main machine's hydraulic system can work under different levels of pressure, and the excessively high temperature produced by the operation of the chipper which may damage the hydraulic equipment can be avoided. The receptacle means 19 essentially is comprised of quick change joint 19*a*, pressure control valve 19*b* and temperature controller or a warning device 19*c***. It should be noted that if the hydraulic chipper specially designed to fit the main machine of the present invention be employed, the pressure and temperature control devices are not needed for short time operation. This time the receptacle means comprises only the quick change joint.

During the operation process, though it is possible to clear up the construction site right with the backhoe means or grab bucket and earth-moving means without removing the driving oil tube **20*b* and the hand-held hydraulic chipper 20*a*, yet as dismounting and mounting are very convenient and rapidly to work out when employing the quick-change joint, it is generally better to remove the driving oil tube 20*b* and the hand-held hydraulic chipper 20*a* first and then to carry on the digging and earth moving processes. If it is really necessary to chip and to clear or to dig at the same time, to prevent the frequent dismounting and mounting, the receptacle means 19 can be directly connected to the preset ports P and T of the multi-way valve 26, as shown by the double dots-dash line in FIG. 6**.

The receptacle means 19 employed by the present invention makes the excavator be characterized in that it contains simultaneously three kinds of operating devices, namely, digging, earth-moving and chipping devices, and is able to carry on digging and chipping processes at the same time, not only making the chipping process easier, but also making it possible to carry on the operations of chipping and clearing away the broken fragments conveniently and efficiently all alone by one single machine.

We claim:

1. An excavator comprising:

a chassis assembly including traveling devices and a vehicle frame;

an earth-moving means pivotally coupled to said chassis assembly;

a swivel supporting means fixedly connected to said chassis assembly;

an upper carriage assembly provided with a main hydraulic system, supporting frame for multi-way valves, a driver's shed or cabin, a driver's seat, an engine, control mechanism and electric system, and fixedly mounted on the swivel supporting means;

an excavating arm pivotally coupled to the upper carriage assembly and including a joint holder, a boom, a bucket arm and driving oil cylinders; and excavating means mounted on the excavating arm, characterized in that said excavating means include a backhoe device comprising a six bar linkage mechanism including a scraper, a bucket including a bucket body, the scraper being pivotally coupled to the bucket body such that is acts as a movable wall of the bucket, a connecting rod, a connecting plate, a swing bar, and the bucket arm, wherein the connecting rod is pivotally coupled to the connecting plate and to the scraper, the connecting plate is pivotaly coupled to the swing bar and to the bucket body, the bucket arm is pivotally coupled to the swing bar and to the bucket body, and one of the driving oil cylinders is pivotally coupled to a pivot between the swing bar and the connecting plate, such that the backhoe device is driven by the driving oil cylinder, and such that the scraper moves during a loading process to enlarge the effective capacity of the bucket and moves during an unloading process to remove a volume of material from the bucket collected during the loading process whereby the bucket body and the scraper revolve in the same direction, with a rule that the bucket body moves quicker, while the scraper moves slower.

2. An excavator comprising:

a chassis assembly including traveling devices and a vehicle frame;

an earth-moving means pivotally coupled to said chassis assembly;

a swivel supporting means fixedly connected to said chassis assembly;

an upper carriage assembly provided with a main hydraulic system, supporting frame for multi-way valves, a driver's shed or cabin, a driver's seat an engine, control mechanism and electric system, and fixedly mounted on the swivel supporting means;

an excavating arm pivotally coupled to the upper carriage assembly and including a joint holder, a boom, a bucket arm and driving oil cylinders; and excavating means mounted on the excavating arm, characterized in that said excavating means include a backhoe device comprising a five bar linkage mechanism including a scraper, a bucket, the bucket having a bucket body and the scraper being pivotally coupled to the bucket body such that it acts as a movable wall of the bucket, a connecting plate, a swing bar and the bucket arm, the connecting plate being slidably coupled to the scraper by means of at least one pin slide block, the scraper being provided with a sliding guide such that the pin slide block can slide freely within the sliding guide, the connecting plate being pivotaly coupled to the bucket body and to the swing bar, the swing bar being pivotally coupled to the bucket arm, the bucket arm being pivotally coupled to the bucket body, and one of the driving oil cylinders being pivotally coupled to a pivot between the swing bar and the connecting plate, such that the backhoe device is driven by the driving oil cylinder and such that the scraper moves during a loading process to enlarge the effective capacity of the bucket and moves during an unloading process to remove a volume of material from the bucket collected during the loading process whereby the bucket body and the scraper revolve in the same direction, with a rule that the bucket body moves quicker, while the scraper moves slower.

* * * * *